US006960724B2

(12) United States Patent
Orlet et al.

(10) Patent No.: US 6,960,724 B2
(45) Date of Patent: Nov. 1, 2005

(54) DUAL STRESS MEMBER CONDUCTIVE CABLE

(75) Inventors: Michael W. Orlet, Houston, TX (US); Monica M. Darpi, Houston, TX (US); Joseph P. Varkey, Missouri City, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

(21) Appl. No.: 10/463,314

(22) Filed: Jun. 17, 2003

(65) Prior Publication Data

US 2004/0060726 A1 Apr. 1, 2004

Related U.S. Application Data

(60) Provisional application No. 60/414,902, filed on Sep. 30, 2002.

(51) Int. Cl.[7] ..... H01B 7/18
(52) U.S. Cl. ..... 174/102 R
(58) Field of Search ..... 174/102 R, 103, 174/105 R, 106, 107, 108; 385/101, 100, 385/106, 107, 109, 111, 112, 113

(56) References Cited

U.S. PATENT DOCUMENTS 2,953,627 A * 9/1960 Malneritch et al. ..... 174/102 R
3,679,812 A * 7/1972 Owens ..... 174/108
3,773,109 A * 11/1973 Eberline ..... 340/855.1
3,784,732 A * 1/1974 Whitfill, Jr. ..... 174/108
4,033,800 A * 7/1977 Ollis ..... 156/48
4,077,022 A * 2/1978 Pitts, Jr. ..... 333/1
4,375,313 A * 3/1983 Anderson et al. ..... 385/103
4,522,464 A * 6/1985 Thompson et al. ..... 385/107
5,414,217 A * 5/1995 Neuroth et al. ..... 174/120 R
5,495,547 A * 2/1996 Rafie et al. ..... 385/101
5,539,849 A * 7/1996 Petisce ..... 385/102
6,343,173 B2 * 1/2002 Hordvik et al. ..... 385/102
6,424,768 B1 * 7/2002 Booth et al. ..... 385/102

OTHER PUBLICATIONS

C & M Corporation, Engineering Design Guide (3rd Edition), 1992, pp. 10 & 13.*

* cited by examiner

*Primary Examiner*—William H. Mayo, III
(74) *Attorney, Agent, or Firm*—David Cate; Tim Curington; Robin Nava

(57) ABSTRACT

A dual stress member electrical cable includes an electrically conductive, load-bearing core, an insulating layer surrounding the core, and an electrically conductive, outer load-bearing member surrounding the insulating layer. The core may be formed of a solid wire of steel, aluminum, or titanium. The insulating layer may be formed of Teflon or PEEK. The outer load-bearing member may be a tube formed of Inconel, stainless steel, galvanized steel, or titanium.

22 Claims, 1 Drawing Sheet

DUAL STRESS MEMBER CONDUCTIVE CABLE

CROSS-REFERENCE TO RELATED APPLICATIONS

This application claims priority from Provisional Application No. 60/414,902, filed Sep. 30, 2002, which is incorporated herein by reference.

BACKGROUND OF THE INVENTION

1. Field of the Invention

This invention relates to electrical cabling and, more particularly, to an electrical slickline cable having two conductive stress members for carrying the tensile loads applied to the cable.

2. Description of Related Art

In the oil and gas industry, well intervention and logging equipment must often be deployed into, and retrieved from, a well by means of a cable supported at the earth's surface. Slickline tools are typically deployed downhole using a wire payed out from a drum and guided over two or more sheaves before entering the well; Steel wires are generally chosen for such service to meet the rigorous physical requirements of the service while maintaining tensile strength without sustaining damage. Such steel wires are not typically used to communicate electrical signals to the attached tool or tools. The wellhead is sealed around the wire by means of a stuffing box using elastomeric seals, which necessitates a smooth outer surface on the wire, as opposed to grease-injected sealing hardware, which is compatible with served or braided cable surfaces.

In many oilfield applications it is necessary to use a cable having a smooth outer surface that is also capable of effectively conducting electrical signals. Such cables typically employ copper wire cores that, although effective electrical conductors, lack sufficient physical strength to carry the tensile load to which the cable is subjected. The load-bearing capability of such cables is typically provided by an outer metal tube surrounding the electrically conductive core and any insulating layers. Schlumberger Technology Corporation of Sugar Land, Tex., U.S.A. uses a conductive slickline cable, designated CSL-A (H400254), that comprises a solid copper wire core, a TEFLON (polytetrafluoroethylene and perfluoroalkox polymers and a trademark of E. I. du Pont de Nemours and Company of Wilmington, Del., U.S.A.) insulating jacket, and a serve of copper wires on the outer diameter of the insulating jacket. A 316L stainless steel tube is formed, welded, and drawn over the core and insulating jacket to form a snug fit. The drawing process work hardens the tube so as to achieve maximum physical properties, specifically tensile strength in the axial direction. However, while this cable has good telemetry capability, its tensile strength and fatigue life are limited to those of the stainless steel tube alone, with the copper core adding little or no tensile strength.

Similar conductive slickline cables utilizing a copper core and a single outer tube of various stainless steels are supplied by Shell Line LLC of Calgary, Alberta, Canada and Danum Well Services of Doncaster, England.

The present invention is directed to overcoming, or at least reducing, the effects of the problems set forth above by providing a conductive slickline cable having an insulated conductor, with the physical robustness of a slickline wire, enhanced tensile strength, and a smooth, round outer surface for sealing purposes. The invention utilizes the space inside the outer tube to increase the overall load carrying capacity of the cable.

BRIEF SUMMARY OF THE INVENTION

In one aspect of the present invention, an electrical cable is provided. The electrical cable includes an electrically conductive, load-bearing core, an insulating layer surrounding the core, and an electrically conductive, outer load-bearing member surrounding the insulating layer.

In another aspect of the present invention, the electrical cable includes a highly conductive coating on the core to increase its electrical conductivity.

In another aspect of the present invention, the electrical cable includes a highly conductive tape or serve applied to the core to increase its electrical conductivity.

In yet another aspect of the present invention, the outer surface of the insulating layer is coated in a highly conductive material to increase the conductivity of the conductive path formed by the outer load-bearing member.

In still another aspect of the present invention, a highly conductive tape or serve is applied to the outer surface of the insulating layer to increase the conductivity of the conductive path formed by the outer load-bearing member.

BRIEF DESCRIPTION OF THE DRAWINGS

The invention may be understood by reference to the following description taken in conjunction with the accompanying drawings in which.

Figure 1:
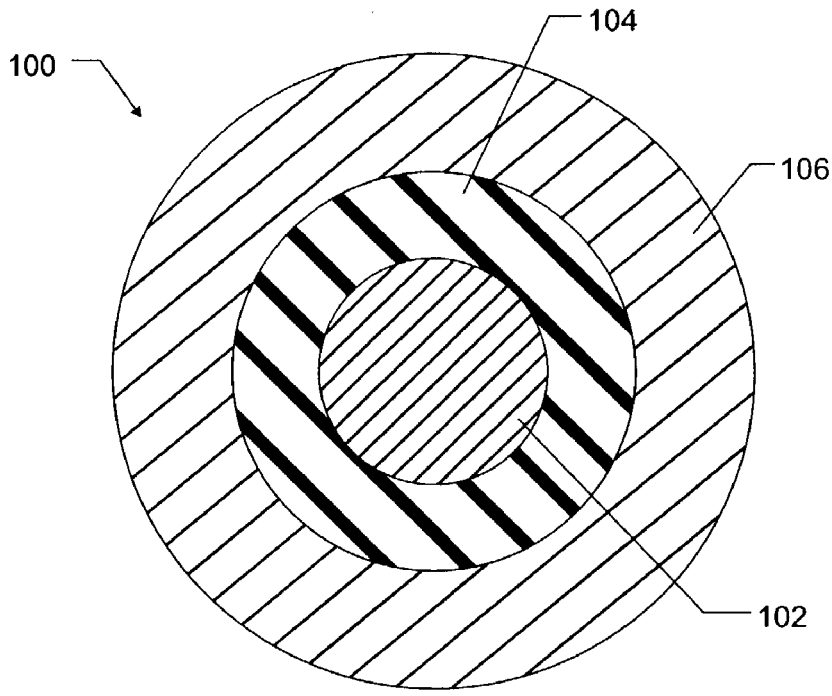
FIG.1 (Prior Art)
FIG. 1 is a cross sectional view of a prior art conductive slickline cable.

While the present invention is susceptible to various modifications and alternative forms, a specific embodiment thereof has been shown by way of example in the drawings and is herein described in detail. It should be understood, however, that the description herein of specific embodiments is not intended to limit the invention to the particular forms disclosed, but, on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of this disclosure.

FIG. 1 depicts, in cross section, a prior art conductive slickline cable designed for oilfield usage. The cable 100 comprises a solid copper core conductor 102, a surrounding electrically insulating layer 104, and a tubular outer cover or member 106 formed of a metal alloy. Although the core conductor 102 is highly electrically conductive, as it is formed of copper, it lacks sufficient tensile strength to serve as a stress member for the cable. Therefore, the outer cover 106 serves as the only stress member.

The term "stress member" or "load-bearing member" is used to describe the component or components of a cable that collectively carry the bulk of the tensile load to which the cable is subjected. In many cables, the stress member is typically formed of helically served wires, usually in two layers at similar angles in opposite directions. These multiple components comprise a single stress member. A cable stress member may also be braided, and may be fabricated from synthetic fibers, such as Kevlar (trademark of E. I. du Pont de Nemours and Company of Wilmington, Del., U.S.A.) or polyester. Alternatively, as illustrated in FIG. 1, the stress member 106 may be a solid component, such as a wire, rod, or tube. In FIG. 1, the copper core conductor 102 contributes less than 5 percent of the total tensile strength of the cable, and is therefore not considered to be a load-bearing member. Typically, cables do not have more than one distinct stress member.

Figure 2:
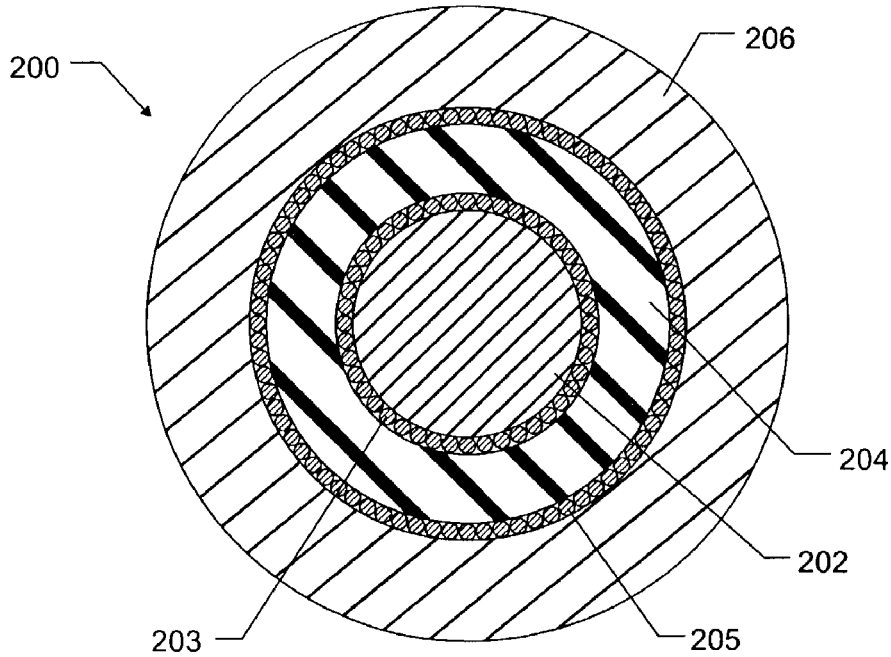
FIG. 2 is a cross sectional view of an illustrative embodiment of an electrical cable according to the present invention.

An illustrative embodiment of an electrical cable according to the present invention is presented in FIG. 2. In the illustrated embodiment, the electrical cable 200 comprises a solid core conductor 202 of steel wire, a surrounding electrically insulating layer 204, and a conductive tubular metal outer cover or member 206. As the core conductor 202 is formed of steel, it is electrically conductive and yet has sufficient tensile strength to serve as an additional stress member for the cable 200. The core conductor 202 and the outer cover may, alternatively, be of braided wire construction. Thus, the cable of the present invention comprises dual stress members, the core conductor 202 and the outer cover or member 206, both of which are electrically conductive.

To enhance its electrical conductivity, the core conductor 202 may be coated in copper or other highly electrically conductive material. Alternatively, a serve of copper wires 203 or copper tape may be applied to the surface of the core conductor 202 to increase its conductivity. The core conductor 202 may also be constructed of other electrically conductive materials that have the requisite tensile strength to act as a stress member, such as, for example, aluminum or titanium, and, if of braided wire constuction, may include a limited number of low tensile strength wire conductors, such as brass and copper. In yet a further alternative embodiment, the load-bearing core 202 may be constructed of a non-conductive carbon, glass, or synthetic fiber-reinforced plastic, with core conductivity provided by a copper or other highly conductive coating thereon.

The tubular metal outer cover or member 206 forms the second stress member of the cable 200 and also serves as the electrical return path. The outer cover 206 may be formed of any metal having suitable tensile strength and electrical conductivity, such as, for example, Inconel, stainless steel, galvanized steel, or titanium.

The dual stress members/conductors 202 and 206 are separated by electrically insulating layer 204 which is formed of a non-conductive material, such as TEFLON (polytetrafluoroethylene and perfluoroalkoxy polymers) or polyetheretherketone (PEEK). To enhance the electrical conductivity of the current path formed by the outer cover 206, the outer surface of the insulating layer 204 may be covered in a conductive material. This conductive material may be in the form of a coating, such as thermally sprayed copper, a conductive tape, or helically served wires 205.

The cable of the present invention uses an additional stress member, conductive core 202, to add strength to the tubular metal outer cover 206. It also adds extra fatigue life to the cable when run over sheaves in tension. In tension, the additional stress member adds tensile strength by increasing the cross sectional area of load-bearing material in the cable. The strength of the two stress members cannot be strictly added. The basic situation is that of two parallel springs, and the load sharing of the two stress members depends upon the material modulus of elasticity of each, the cross sectional area of each, and the boundary conditions at the termination.

Assuming both stress members are terminated such that there is no relative displacement at the termination, there will be identical longitudinal displacement in all components of the cable. The force in each individual stress member will equilibrate such that the longitudinal strain in each is the same. This holds true even if the Young's modulus of one member changes due to inelastic deformation. However, in this case, the forces will be redistributed between the members. This redistribution will depend somewhat on the stiffness of the material between the two stress members and the interfaces of that material with each member (slipping, frictional, or bonded). Likewise, the interfacial material is important in cases where the two stress members are not bound longitudinally at the termination.

As the cable passes over a sheave, it is subjected to bending. The tension in the cable causes it to bend to conform to the diameter of the sheave. This is a different situation than bending encountered in traditional beam theory mechanics in that the curvature of the cable is prescribed rather than a result of the applied bending moment. The strain at a point in the member being bent is assumed to be a linear function of the distance from the neutral axis of the cable, and not dependent on the cross sectional characteristics or the material modulus. Therefore, if the tension in the cable is ignored, the addition of the central stress member will not affect the strains seen by the outer tube. The assumption is made that if the strain caused by bending exceeds the elastic point of the material, the structure will be adversely affected, namely, the fatigue life will be limited. Each time the cable is cycled over a sheave, partial yielding of the cross section and resulting residual strains will cause the structure to succumb to low-cycle fatigue failure. It is therefore advantageous to reduce the extent of yielding during use of the cable.

As stated above, it is the cable tension that acts to cause the bending of the cable over the sheave. This tension is typically much higher than the minimum tension needed to conform the cable over the sheave. In the case where tension is just sufficient to cause conformation to the sheave diameter, the top of the tubular outer cover 206 is under tension while the bottom of the tubular outer cover 206 is under compression. Additional tension causes a reduction in the compression on the compression side of the outer cover 206 and an increase in the tension in the tension side. This acts to yield more of the tubular outer cover cross section in tension. The addition of the central stress member 202 decreases the extent of the tensile inelastic strains. The result is both increased maximum tension over a sheave, as well as increased fatigue life of the cable under cyclic bending under tension conditions.

The presently preferred embodiment of the invention uses a 0.125 inch (3.2 mm) outer diameter tube of Inconel 825 with a 0.022 inch (0.6 mm) wall thickness, welded and drawn over the core, which consists of a 0.012 inch (0.3 mm) thick layer of PEEK 381G, tube extruded over a cleaned, galvanized, high carbon steel wire.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An electrical cable consisting of:

an electrically conductive, load-bearing core, the core having a diameter of about 0.06 inches;

an electrically insulating layer surrounding the core, wherein a conductive material covers the insulating layer; and an electrically conductive metal tube surrounding the insulating layer, wherein the load-bearing core and electrically insulating layer substantially fill the volume within the metal tube.

2. The electrical cable of claim 1, wherein the core is formed of a solid wire.

3. The electrical cable of claim 1, wherein the core is formed of a material selected from the group consisting of steel, aluminum, and titanium.

4. The electrical cable of claim 3, wherein the core is coated with copper, the insulating layer is formed of TEFLON or PEEK, and the metal tube selected from the group consisting of INCONEL, stainless steel, galvanized steel, and titanium.

5. The electrical cable of claim 1, wherein the insulating layer is formed of TEFLON or PEEK.

6. The electrical cable of claim 1, wherein the metal tube is formed of a material selected from the group consisting of nickel alloy, stainless steel, galvanized steel, and titanium, and wherein the metal tube has a diameter of about 0.125 inches.

7. The electrical cable of claim 1, wherein the core is coated with copper.

8. The electrical cable of claim 1, wherein the core has a serve of copper wires applied to the surface of the core.

9. The electrical cable of claim 1, wherein the core is coated with a copper tape applied to the surface of the core.

10. The electrical cable of claim 1, wherein the core is coated with a conductive coating selected from the group of coating, tape, and helically served wires.

11. The electrical cable of claim 1, wherein the core is coated with a conductive coating comprising copper.

12. The electrical cable of claim 1, wherein a conductive coating covers the load-bearing core, the load-bearing core being is selected from the group of non-conductive carbon, glass, or synthetic fiber-reinforced plastic.

13. An electrical cable consisting of:

a single solid wire core, the core having a diameter of about 0.06 inches;

an electrically insulating layer surrounding the core; and an electrically conductive tubular metal outer cover surrounding the insulating layer wherein the solid wire core and electrically insulating layer substantially fill the volume within the tubular metal outer cover.

14. The electrical cable of claim 13, wherein the insulating layer is formed of TEFLON or PEEK.

15. The electrical cable of claim 13, wherein the tubular metal outer cover is formed of a material selected from the group consisting of nickel alloy, stainless steel, galvanized steel, and titanium, and wherein the tubular metal outer cover has a diameter of about 0.125 inches.

16. The electrical cable of claim 13, wherein the core is coated with copper, the core being selected from the group consisting of steel, aluminum, and titanium.

17. The electrical cable of claim 13, wherein a conductive coating applied to the outer surface of the insulating layer.

18. The electrical cable of claim 17, wherein the conductive coating is copper.

19. The electrical cable of claim 13, wherein the core is formed of carbon, glass, or synthetic fiber-reinforced plastic, the core including a conductive coating.

20. An electrical cable consisting of:

a load-bearing core having an electrically conductive coating thereon, the core having a diameter of about 0.06 inches;

an electrically insulating layer surrounding the coated core; wherein a conductive material covers the insulating layer;

an electrically conductive load-bearing member surrounding the insulating layer, wherein the electrically conductive load-bearing member is a metal; and wherein the load-bearing core and electrically insulating layer substantially fill the volume within the metal tube.

21. The electrical cable of claim 20, wherein the load-bearing core is formed of carbon, glass, or synthetic fiber-reinforced plastic.

22. The electrical cable of claim 21, wherein the electrically conductive coating comprises copper.

* * * * *